US011231256B2

(12) United States Patent
Alexandre et al.

(10) Patent No.: US 11,231,256 B2
(45) Date of Patent: Jan. 25, 2022

(54) METHOD FOR MANUFACTURING A DEVICE FOR LOCATING AN IMPACT HAVING AT LEAST THREE TRANSDUCERS ATTACHED AGAINST AN INTERACTIVE SURFACE

(71) Applicant: Commissariat a l'energie atomique et aux energies alternatives, Paris (FR)

(72) Inventors: Jean-Marc Alexandre, Verrieres-le-Buisson (FR); Robert Boden, Dourdan (FR); Christian Bolzmacher, Montrouge (FR)

(73) Assignee: Commissariat a l'energie atomique et aux energies alternatives, Paris (FR)

( * ) Notice: Subject to any disclaimer, the term of this patent is extended or adjusted under 35 U.S.C. 154(b) by 62 days.

(21) Appl. No.: 16/637,098

(22) PCT Filed: Jul. 19, 2018

(86) PCT No.: PCT/FR2018/051839
§ 371 (c)(1),
(2) Date: Feb. 6, 2020

(87) PCT Pub. No.: WO2019/030438
PCT Pub. Date: Feb. 14, 2019

(65) Prior Publication Data

US 2020/0248993 A1 Aug. 6, 2020

(30) Foreign Application Priority Data

Aug. 9, 2017 (FR) ..... 1757599

(51) Int. Cl.
*F41J 5/056* (2006.01)

(52) U.S. Cl.
CPC ..... *F41J 5/056* (2013.01)

(58) Field of Classification Search
CPC . F41J 5/056; H03H 3/08; H04R 17/00; G06F 3/043–0436
See application file for complete search history.

(56) References Cited

U.S. PATENT DOCUMENTS 5,095,433 A 3/1992 Botarelli et al.
5,936,207 A * 8/1999 Kobayashi ..... G06F 3/0433 178/18.01

(Continued)

FOREIGN PATENT DOCUMENTS

EP 3 199 907 A1 8/2017
FR 2682608 A1 * 4/1993 ..... F41J 5/056
JP 57-181874 A 11/1982

OTHER PUBLICATIONS

English machine translation of FR 2682608 A1 (Year: 1993).*
International Search Report dated Oct. 26, 2018 in PCT/FR2018/051839 filed Jul. 19, 2018, 3 pages

*Primary Examiner* — Laura Davison
(74) *Attorney, Agent, or Firm* — Oblon, McClelland, Maier & Neustadt, L.L.P.

(57) ABSTRACT

This method for manufacturing a device for locating an impact comprising an interactive surface having a front face for receiving an impact and at least three transducers that need to be distributed and attached against the front face or a rear face of the interactive surface, comprises the following steps: determining a central positioning point for each transducer on the front face or rear face of the interactive surface; attaching each transducer, via the lower conductive layer thereof forming a first electrode, around the central positioning point thereof. It further comprises, following the attachment of each transducer, a step of machining the free upper conductive layer of at least one of the transducers, using a machine tool, at least as far as a piezoelectric intermediate layer of this transducer, in order to form a (Continued)

Figure 1:
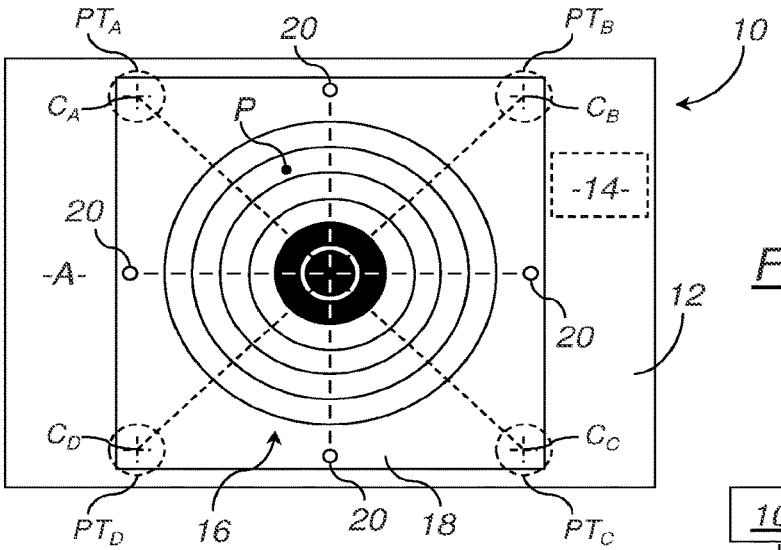

second electrode of this transducer, centering it around the central positioning point thereof.

10 Claims, 1 Drawing Sheet

(56) References Cited

U.S. PATENT DOCUMENTS

| | | | | |
|---|---|---|---|---|
| 6,367,800 | B1 * | 4/2002 | Sheck | F41J 5/056 273/371 |
| 6,933,930 | B2 | 8/2005 | Devige et al. | |
| 7,345,677 | B2 | 3/2008 | Ing et al. | |
| 7,685,862 | B1 * | 3/2010 | Hughes | F41J 5/056 73/12.11 |
| 8,330,744 | B2 | 12/2012 | Nikolovski et al. | |
| 8,356,818 | B2 * | 1/2013 | Mraz | F41J 5/041 273/371 |
| 2017/0069821 | A1 * | 3/2017 | Mouri | H01L 41/113 |

* cited by examiner

METHOD FOR MANUFACTURING A DEVICE FOR LOCATING AN IMPACT HAVING AT LEAST THREE TRANSDUCERS ATTACHED AGAINST AN INTERACTIVE SURFACE

The present invention relates to a method for manufacturing a device for locating an impact with at least three transducers attached against an interactive surface. It also relates to a device for locating an impact resulting from such a method for manufacturing.

It more precisely relates to the manufacturing of a device for locating an impact comprising an interactive surface having a front face for receiving an impact and at least three transducers, that need to be distributed and attached against the front face or a rear face of the interactive surface, designed to capture the progressive mechanical waves propagating in the interactive surface from the impact and transform them into electrical signals, with the method for manufacturing comprising the following steps:

- determining a central positioning point for each transducer on the front face or rear face of the interactive surface,
- attaching each transducer around the central positioning point of same, with each transducer having a lower conductive layer forming a first electrode through which it is attached against the front face or rear face of the interactive surface, a piezoelectric intermediate layer and a free upper conductive layer intended to form a second electrode.

Many devices with an interactive surface are known, such as devices for displaying, mobile telephones or other potable personal digital assistance devices. The interface thereof is in general a flat and rectangular screen with which a user can interact using a projectile, a stylus or even a finger. For example, a leisure or sportive firing range with automatic locating of impacts can comprise such a device, with a target representation displayed on an interactive surface or plate, in particular on the front or rear face thereof. Note however that the invention applies more generally to any type of object that has an interactive surface that is able to propagate progressive mechanical waves from an impact, with this surface not being necessarily flat, or with a rectangular contour.

The term interactive surface means a two-dimensional or three-dimensional surface, that has a certain thickness, capable of changing shape in the static and dynamic sense of elasticity of the materials when it is subjected to an impact such as a touch, a contact force, a mechanical pulse or an impact, thus allowing for the propagation of progressive mechanical waves that can be detected using transducers, in particular surface acoustic waves such as Lamb waves, from the place of impact. The surface deformation can be sub-millimetric that cannot be perceived by the unaided eye. Plastic, glass or metal surfaces are suitable.

Each one of the known interactive surface devices comprises means for locating an impact using one or several detection techniques. A strong trend in reducing the manufacturing costs and in reducing the size aims to retain only the simplest technologies that use a limited number of piezoelectric transducers.

A first solution is disclosed in patent U.S. Pat. No. 7,345,677 B2. It is based on a recognition of the position on an impact via learning. The method implemented performs a cross-correlation between at least one measured acoustic signal coming from the detection of an acoustic wave generated by an impact on the interactive surface of the object and a reference set referred to as "set of signatures" formed of pre-recorded pulse acoustic responses, with each one relating to a predefined position that is sought to be associated with a function and recognize when an impact is placed on this position.

A second solution, for example disclosed in patent U.S. Pat. No. 8,330,744 B2, consists in measuring the disturbance of an impact on the propagation of progressive mechanical waves emitted regularly in the interactive surface independently of this impact. This solution is deemed to be more precise and reliable than the preceding solution, in particular for qualifying or monitoring the impact, but it is also based on a recognition of the position of an impact via learning.

These two first solutions have the disadvantage of depending on this learning which can be both complex to implement and rapidly unusable in case of variations in the medium or in the interactive surface. They furthermore require rather substantial calculating powers.

A third solution, older, is based on measuring a difference in transit time of a wave packet generated by an impact to a plurality of piezoelectric detectors and on the analytical calculation by triangulation, using a pre-established mathematical formula according to the assumed position of the detectors, of the position of a source emitting the wave packet. An analytical calculation example is for example detailed in U.S. Pat. No. 6,933,930 B2. Thus, this solution requires a device for locating an impact including:

- at least three transducers arranged and distributed against the front face or rear face of the interactive surface in such a way that is sufficiently precise so that the analytical calculation does not generate any significant error, and
- an electronic central unit, connected to the transducers in order to receive their electrical signals, programmed to locate the impact in the interactive surface through an analysis of the differences in propagation times of progressive mechanical waves coming from the impact to the transducers based on detection instants of the impact identified in the electrical signals received.

Generally, it is thus possible to locate an impact of a finger or of a one-off object (for example a projectile or a stylus), since the latter is then the emitter of a pulse. But with this rather old technology, yet advantageously simple and preferred in terms of leisure or sportive firing because it allows for the use of interactive surfaces that are both resistant and sensitive to impacts, it is difficult to achieve good locating precision, because it is difficult to precisely position the transducers in accordance with the pre-established mathematical formula based on coordinates of each central positioning point of each transducer.

Any poor positioning of at least one of the transducers generates locating errors due to the difference between the actual position of the transducers and that, theoretical, that was used as the calculation basis for the pre-established mathematical formula. It is thus shown for example that for an impact surface of 200 mm×200 mm with four transducers arranged in a square, a poor positioning of 100 μm of each one of them generates shifting and linearity errors. In terms of shifting, that of the target center can reach in these conditions up to 100 μm on the abscissa and on the ordinates. In terms of linearity, the error is according to the position of the impact, increasing from the measuring center to the periphery of the impact surface, and can thus reach up to 340 μm at the periphery in the aforementioned conditions. In addition, to these errors are added resolution errors due to the quantification of the measurements returned by the transducers at a given clock rate. With an 80 Mhz clock, a steel sheet interactive plate entailing a propagation speed of Lamb waves close to 0.53 mm/μs, the resolution errors can reach +/−50 μm.

Thus, for a leisure or sportive firing application at 10 m using an impact surface of 200 mm×200 mm, the four transducers have to be attached with an uncertainty less than 100 μm, which is very difficult to obtain with the known methods of manufacturing. This leads indeed to a complex manufacturing that entails perfectly controlling the dimensions of the transducers and the relative axial arrangements of the electrodes and of the piezoelectric layer of each transducer, of having a precise positioning template, to the nearest 50 μm in an impact surface of 200 mm×200 mm for a leisure and sportive firing target at 10 m and to the nearest 100 μm in an impact surface of 600 mm×600 mm for a leisure and sportive firing target at 50 m, of being able to perfectly center this template on the measuring center of the interactive surface, of controlling the attaching of the transducers within these tolerances, despite the effects of retraction when an adhesive is used, and above all controlling the positioning of the sensitive piezoelectric zone in relation to the two electrodes thereof. All of these constraints generate possibilities for errors which accumulate in such a way that they make manufacturing very difficult to carry out.

Alternatively, a numerical method could be considered in order to determine the actual positioning of the transducers after attaching and to deduce therefrom the mathematical triangulation formula or the numerical approximation thereof. But such a method of calibration after attaching is complex and expensive.

It may thus be sought to design a method for manufacturing a device for locating an impact with at least three transducers attached against an interactive surface which makes it possible to overcome at least part of the aforementioned problems and constraints.

A method for manufacturing a device for locating an impact is therefore proposed comprising:

- an interactive surface having a front face for receiving an impact, and
- at least three transducers, that need to be distributed and attached against the front face or a rear face of the interactive surface, designed to capture the progressive mechanical waves propagating in the interactive surface from the impact and transform them into electrical signals, with the method for manufacturing comprising the following steps:

- determining a central positioning point for each transducer on the front face or rear face of the interactive surface,
- attaching each transducer around the central positioning point of same, with each transducer having a lower conductive layer forming a first electrode through which it is attached against the front face or rear face of the interactive surface, a piezoelectric intermediate layer and a free upper conductive layer intended to form a second electrode, the method further comprising, following the attaching of each transducer, a step of machining the free upper conductive layer of at least one of the transducers using a machine tool at least as far as the piezoelectric intermediate layer of this transducer in order to form the second electrode of this transducer by centering it around the central positioning point of same as a portion of the upper conductive layer arranged in the free upper conductive layer.

Thus, thanks to the machining which is notoriously controlled in a much more precise manner than the attaching itself, with a positioning uncertainty in machining that can easily remain less than 10 μm, the centering of the functional portion of each transducer around the central positioning point of same is obtained in a much more satisfactory manner than by the known techniques of manufacturing. The adequacy between the actual positioning of the transducers and that desired and theoretical of the central positioning points thereof, making it possible to ensure the desired precision of the measurements which will then be taken by the device, if then acquired. All of this is obtained without any particular requirement on the dimensions of transducers conventionally manufactured and on the step of attaching.

Optionally, the machining of the free upper conductive layer of said at least one of the transducers is carried out circularly in order to form the second electrode in the form of a disk centered on the central positioning point of this transducer.

Optionally also, the step of machining is carried out on all the transducers attached against the front face or rear face of the interactive surface.

Optionally also, the machine tool carrying out the machining is a laser machining device.

Optionally also, four central positioning points arranged as a diamond, rectangle or square are determined on the front face or rear face of the interactive surface for the attaching of four transducers.

Optionally also, the step of machining includes a drilling of holes in the interactive surface intended to receive reference pins for positioning a target support.

Optionally also, the step of machining includes a marking of a measuring center in the interactive surface.

Optionally also, a method for manufacturing a device for locating an impact according to the invention can comprise, following the step of machining, a step of connecting via welding of two conductive wires to each transducer, one to the first electrode formed in the lower conductive layer of this transducer and the other to the second electrode formed in the portion of the upper conductive layer of this transducer, for a processing of the signals provided by this transducer.

A device for locating an impact is also proposed comprising:

- an interactive surface having a front face for receiving an impact, and
- at least three transducers, distributed and attached around respective central positioning points against the front face or a rear face of the interactive surface, designed to capture the progressive mechanical waves propagating in the interactive surface from the impact and transform them into electrical signals, with each transducer having a lower conductive layer forming a first electrode through which it is attached against the front face or rear face of the interactive surface, a piezoelectric intermediate layer and a free upper conductive layer intended to form a second electrode, the free upper conductive layer of at least one of the transducers comprising a portion of the layer forming the second electrode centered on the central positioning point of this transducer and electrically insulated from another peripheral portion of the free upper conductive layer by a machining carried out at least as far as the piezoelectric intermediate layer of this transducer.

A leisure or sportive firing range is also proposed comprising:

- a device for locating an impact according to the invention, further comprising a central unit for electronically processing electrical signals provided by said at least three transducers, designed for locating an impact through an analysis of the differences in propagation times of progressive mechanical waves coming from the impact to the transducers, and at least one target representation intended to be displayed in a plane of the interactive surface of the device for locating an impact.

Figure 2:
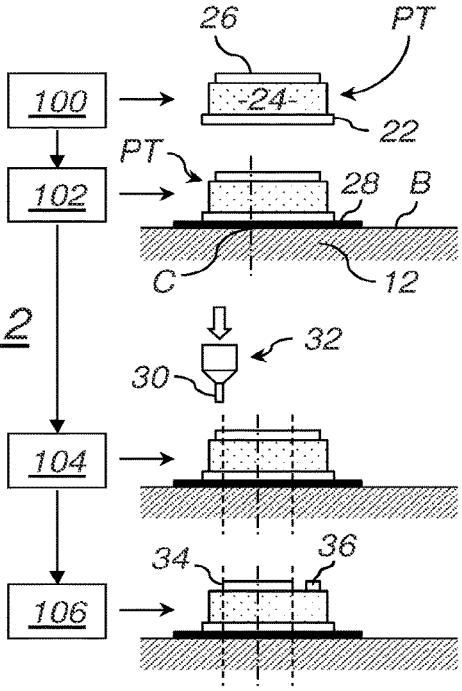
Figure 3:
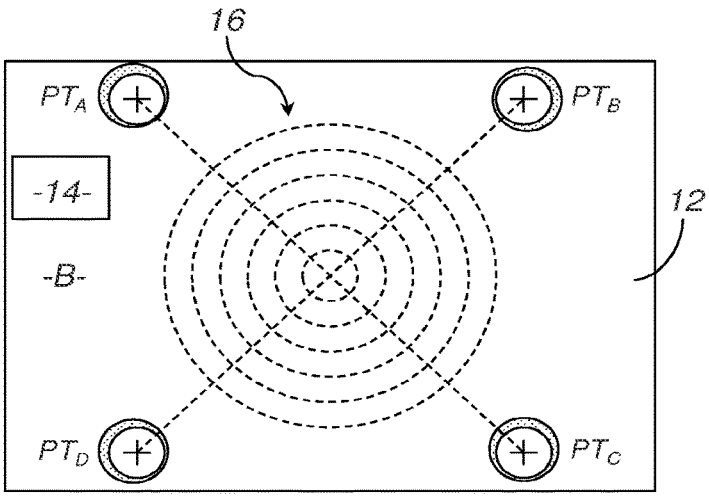

The invention shall be better understood using the following description, given solely by way of example and in reference to the accompanying drawings wherein:

FIG. 1 diagrammatically shows as a front view the general structure of a device for locating an impact with four transducers attached against an interactive surface, according to an embodiment of the invention, FIG. 2 shows the successive steps of a method for manufacturing the device of FIG. 1, according to an embodiment of the invention, and FIG. 3 shows the device of FIG. 1 as a rear view.

The device 10 for locating an impact shown as a front view in FIG. 1 comprises an interactive surface in the form of a plate 12 having a front face A for receiving an impact P and a rear face B (shown in FIG. 3) against which are distributed and attached four piezoelectric transducers $PT_A$, $PT_B$, $PT_C$ and $PT_D$. These four transducers, of which only the functional portion is delimited with short interrupted lines in FIG. 1, are centered on four respective central positioning points $C_A$, $C_B$, $C_C$ and $C_D$. They are designed to capture the progressive mechanical waves propagating in the interactive plate 12 from the impact P and transform them into electrical signals.

The device 10 further comprises a central unit 14 for the electronic processing of electrical signals provided by the four piezoelectric transducers $PT_A$, $PT_B$, $PT_C$ and $PT_D$, designed for locating an impact through an analysis of the differences in propagation times of progressive mechanical waves coming from the impact P to the piezoelectric transducers $PT_A$, $PT_B$, $PT_C$ and $PT_D$. This central unit 14 is for example arranged against the rear face B of the interactive plate 12. Optionally, it can furthermore provide an estimation of a power of each impact located. Each impact detected can then be stored in memory with its location and its power in order to form a history of the impacts.

The device 10 is, in the example of FIG. 1, used in a leisure or sporting firing range which relates to an activity of leisure or sportive firing with a weapon, rifle or pistol, compressed air or powder, as well as to an activity of archery, crossbow, blowgun, darts or other. In accordance with this use, a target representation 16 is displayed in a plane of the interactive plate 12. According to a possible embodiment, this target representation 16 is reproduced on a piece of cardboard 18 attached against the front face A of the interactive plate 12 and correctly centered in relation to the piezoelectric transducers $PT_A$, $PT_B$, $PT_C$ and $PT_D$ using reference pins 20 in position. More precisely, the four piezoelectric transducers $PT_A$, $PT_B$, $PT_C$ and $PT_D$ are arranged at the four corners of a square and the reference pins 20 are arranged by manufacturing in such a way as to place the target center of the target representation 16 precisely on the measuring center that coincides with the center of the square.

An example of a method for manufacturing the device 10 shall now be detailed in reference to FIG. 2.

During a first step 100, the four piezoelectric transducers $PT_A$, $PT_B$, $PT_C$ and $PT_D$ are obtained: by manufacturing or purchase. No particular constraint is imposed on the design thereof. Each piezoelectric transducer, identified by the general reference PT in FIG. 2, has a lower conductive layer 22 forming a first electrode through which it is attached against the rear face B of the interactive plate 12, a piezoelectric intermediate layer 24 and a free upper conductive layer 26 intended to form a second electrode.

During a following step 102, each one of the four piezoelectric transducers $PT_A$, $PT_B$, $PT_C$ and $PT_D$ is attached, via its lower conductive layer 22, to the rear face B of the interactive plate 12. To this effect, a central positioning point, identified by the general reference C in FIG. 2, is determined precisely and beforehand for each transducer PT on the rear face B of the interactive plate 12. The currently known marking techniques make it possible to position such a central point C with a precision on the scale of a micrometer. Then, each piezoelectric transducer PT is attached around the central positioning point C of same, for example using a layer of adhesive 28, without any particular precise adjustment. Note for example in FIG. 2 that the transducer PT is not exactly centered on the central point C after attaching by gluing. At the end of this step 102, the arrangement of each transducer PT glued can be examined in order to check if it is correctly centered in light of the precision requirements.

During a following step 104, each piezoelectric transducer PT which is not correctly centered, or by default each one of the four piezoelectric transducers $PT_A$, $PT_B$, $PT_C$ and $PT_D$ if this verification was not carried out at the end of the step 102, is placed facing the machining tip 30 of a machine tool 32. The free upper conductive layer 26 thereof is then machined at least as far as the intermediate piezoelectric layer 24 thereof in order to form the second electrode of this piezoelectric transducer PT by centering it around the central point C as a portion 34 of the upper conductive layer arranged in the free upper conductive layer 26. To do this, the machining tip 30 is for example placed at a desired distance R from the axis of the central point C and the machining is carried out circularly around this axis in order to form the second electrode according to a disk of radius R precisely centered on C. The precise positioning of the machine tool 32 is done for example by geometrical referencing using two right angle edges of the interactive plate 12. Thanks to the machining carried out, this disk is then electrically insulated from any remainder 36 of the free upper conductive layer 26 forming another portion located at the periphery of the latter. The piezoelectric transducer PT thus machined is therefore functionally centered on C since it is solely its useful cylindrical portion with radius R centered on the normal axis passing through C which fulfills the detection function. During this step 104 also, holes can be drilled by machining in order to define as more precisely as possible the positioning of the reference pins 20 by receiving them. The center of the square formed by the four piezoelectric transducers $PT_A$, $PT_B$, $PT_C$ and $PT_D$, or measuring center which has to coincide with the target center of the target representation 16, can also be marked during this step.

During a last step 106, the first electrode formed from the lower conductive layer 22 and the second electrode formed of the portion 34 of upper conductive layer are electrically connected, for example by welding of conductive wires, one to the ground (or – terminal), the other to the central processing unit 14 (or + terminal), for a processing of the signals provided by the machined piezoelectric transducer PT.

The result of the method for manufacturing detailed hereinabove is shown in FIG. 3. It can be seen here that although the piezoelectric transducers $PT_A$, $PT_B$, $PT_C$ and $PT_D$ have been attached by gluing approximately around the respective central positioning points thereof, the machining carried out in the step 104 makes it possible to correct this by precisely recentering the functional portion of each piezoelectric transducer around the central positioning point of same. Each free upper conductive layer 26 visible in FIG. 3 comprises a portion that is correctly centered (white) and electrically insulated from another peripheral portion inactive (textured) which becomes passive due to the insulation thereof.

It clearly appears that the method for manufacturing described hereinabove makes it possible to obtain a device for locating an impact with transducers attached against an interactive surface wherein the transducers are very precisely positioned. The uncertainty is that of the machining which is very low, generally less than 10 μm. It therefore makes it possible to consider a use of the device obtained for leisure or sportive firing applications with electronic targets which are highly demanding in terms of precision of the measurements for locating impacts: a precision of about 100 μm is required at the center of the target for calculations to the point or to one-tenth of a point regardless of the firing disciplines while the method of manufacturing presented hereinabove makes it possible to largely achieve this precision over the entire impact surface.

Note moreover that the invention is not limited to the embodiment described hereinabove.

Thus an attaching of the transducers against the rear face B of the interactive plate 12 using an adhesive has been described. But alternatively, such an attaching could be considered using mechanical interfaces for positioning transducers. The attaching of the transducers could also be done against the front face A of the interactive plate 12 as long as a protection against the impacts is provided.

A target representation 16 on a cardboard support 18 has also been described, but the support could alternatively be a target template carried out in a hard material that makes it possible to provide very high positioning precision using reference pins 20. If a resistant opaque support is desired, the target representation 16 can be formed on this support via etching, silkscreen, chemical or electrochemical attack by galvanoplasty or electroplating, or color insert in the mass. Also alternatively, the target representation could be an image or a video projected, on a screen or by video projector, and the positioning of the target center on the measuring center could be ensured by pixel alignment.

A target representation 16 displayed in the front face A of the interactive plate 12 has also been described. But alternatively, it could be displayed against the rear face B, in such a way as to protect from impacts, in which case it is necessary that the interactive plate 12 be transparent. In terms of materials, the interactive plate 12 can be chosen, according to the targeted applications, made from polycarbonate, glass which may be armored, steel alloy, etc. It is suitable to choose such or such material according to its transparency and/or resistance to the expected projectiles.

An interactive plate 12 has also been described, but any interactive surface, in particular non-planar, could more generally be suitable, such as for example a three-dimensional object shell.

A central processing unit 14 has also been described arranged at the rear face B of the interactive plate 12. But alternatively, the central processing unit 14 could be at least partially offset, in particular on a computer. Many other alternatives are possible for designing the set formed of the interactive plate 12, the display support of the target representation 16 and the central processing unit 14.

A machine tool 32 with a machining tip 30 has also been described that, alternatively, could be replaced with a laser machining device.

A set of four transducers has also been described, but three transducers can suffice to establish a location by analytical triangulation calculation. More transducers can also be provided in order to improve the location via analytical calculation.

It will appear more generally to those skilled in the art that various modifications can be made to the embodiment described hereinabove, in light of the teaching that has just been disclosed to them. In the presentation of the invention which is made hereinabove between page 4 line 22 and page 6 line 33, the terms used must not be interpreted as limiting the invention to the embodiment disclosed in the present description, but must be interpreted as to include therein all the equivalents of which the foresight is within the scope of those skilled in the art by applying their general knowledge to the implementation of the teaching which has just been disclosed to them.

The invention claimed is:

1. A method for manufacturing a device for locating an impact comprising:

an interactive surface having a front face for receiving an impact, and at least three transducers, that need to be distributed and attached against the front face or a rear face of the interactive surface, designed to capture progressive mechanical waves propagating in the interactive surface from the impact and transform them into electrical signals, with the method for manufacturing comprising the following steps:

determining a central positioning point for each transducer on the front face or rear face of the interactive surface, attaching each transducer around the central positioning point of same, with each transducer having a lower conductive layer forming a first electrode through which it is attached against the front face or the rear face of the interactive surface, a piezoelectric intermediate layer and a free upper conductive layer intended to form a second electrode, characterized in that it further comprises following the attaching of each transducer, a step of machining the free upper conductive layer of at least one of the transducers using a machine tool at least as far as the piezoelectric intermediate layer of this transducer in order to form the second electrode of this transducer by centering the second electrode around the central positioning point of same as a portion of the free upper conductive layer arranged in the free upper conductive layer.

2. The method for manufacturing a device for locating an impact according to claim 1, wherein the machining of the free upper conductive layer of said at least one of the transducers is carried out circularly in order to form the second electrode in the form of a disk centered on the central positioning point of this transducer.

3. The method for manufacturing a device for locating an impact according to claim 1, wherein the step of machining is carried out on all the transducers attached against the front face or the rear face of the interactive surface.

4. The method for manufacturing a device for locating an impact according to claim 1, wherein the machine tool carrying out the machining is a laser machining device.

5. The method for manufacturing a device for locating an impact according to claim 1, wherein four central positioning points arranged as a diamond, rectangle or square are determined on the front face or rear face of the interactive surface for the attaching of four transducers.

6. The method for manufacturing a device for locating an impact according to claim 1, wherein the step of machining includes a drilling of holes in the interactive surface intended to receive reference pins for positioning a target support.

7. The method for manufacturing a device for locating an impact according to claim 1, wherein the step of machining includes a marking of a measuring center in the interactive surface.

8. The method for manufacturing a device for locating an impact according to claim 1, including, following the step of machining, a step of connecting via welding of two conductive wires to each transducer, one to the first electrode formed in the lower conductive layer of this transducer and the other to the second electrode formed in the portion of the upper conductive layer of this transducer, for a processing of the signals provided by this transducer.

9. A device for locating an impact including:

an interactive surface having a front face for receiving an impact, and at least three transducers, distributed and attached around respective central positioning points against the front face or a rear face of the interactive surface, designed to capture progressive mechanical waves propagating in the interactive surface from the impact and transform them into electrical signals, with each transducer having a lower conductive layer forming a first electrode through which said each transducer is attached against the front face or the rear face of the interactive surface, a piezoelectric intermediate layer and a free upper conductive layer intended to form a second electrode, the device being characterized in that the lower conductive layer of at least one of the transducers is not exactly centered to the respective central positioning point, the free upper conductive layer of at least one of the transducers includes a layer portion forming the second electrode centered on the central positioning point of this transducer, which is shifted from a center point of the lower conductive layer, and electrically insulated from another peripheral portion of the free upper conductive layer by a machining carried out at least as far as the piezoelectric intermediate layer of this transducer.

10. A leisure or sportive firing range including:

a device for locating an impact according to claim 9, further comprising a central unit for electronic processing of the electrical signals provided by said at least three transducers, designed for locating an impact through an analysis of differences in propagation times of progressive mechanical waves coming from the impact to the transducers, and at least one target representation intended to be displayed in a plane of the interactive surface of the device for locating an impact.

* * * * *